US010750863B2

(12) United States Patent
Nugent

(10) Patent No.: US 10,750,863 B2
(45) Date of Patent: Aug. 25, 2020

(54) DRAWER SYSTEM HAVING PRIMARY AND CONCEALED DRAWERS

(71) Applicant: Michael A. Nugent, Loxahatchee, FL (US)

(72) Inventor: Michael A. Nugent, Loxahatchee, FL (US)

(73) Assignee: Black Pearl Woodworks LLC, Loxahatchee, FL (US)

( * ) Notice: Subject to any disclaimer, the term of this patent is extended or adjusted under 35 U.S.C. 154(b) by 0 days.

(21) Appl. No.: 16/039,657

(22) Filed: Jul. 19, 2018

(65) Prior Publication Data

US 2019/0021495 A1 Jan. 24, 2019

Related U.S. Application Data

(60) Provisional application No. 62/534,738, filed on Jul. 20, 2017.

(51) Int. Cl.

| | |
|---|---|
| ***A47B 88/80*** | (2017.01) |
| ***A47B 88/919*** | (2017.01) |
| ***A47B 88/70*** | (2017.01) |
| ***A47B 88/75*** | (2017.01) |
| *A47B 95/02* | (2006.01) |

(52) U.S. Cl.

CPC ..... *A47B 88/80* (2017.01); *A47B 88/70* (2017.01); *A47B 88/75* (2017.01); *A47B 88/919* (2017.01); *A47B 2095/024* (2013.01)

(58) Field of Classification Search

CPC ..... A47B 88/40; A47B 88/70; A47B 88/75; A47B 88/80; A47B 88/919

USPC ..... 312/204, 330.1, 334.1

See application file for complete search history.

(56) References Cited

U.S. PATENT DOCUMENTS

| | | | | | |
|---|---|---|---|---|---|
| 128,439 | A * | 6/1872 | Unna | | |
| 158,423 | A * | 1/1875 | Knight | | |
| 444,151 | A * | 1/1891 | Hull | | |
| 1,061,646 | A * | 5/1913 | Welliver | A47B 63/02 | 312/301 |
| 1,993,477 | A * | 3/1935 | Gourley | A47B 63/02 | 312/301 |
| 5,044,059 | A * | 9/1991 | De Giulio | A47B 88/994 | 29/401.1 |
| 6,086,176 | A * | 7/2000 | Aoyama | A47B 67/04 | 312/286 |
| 7,901,017 | B1 * | 3/2011 | Kafferlin | A47B 88/467 | 312/219 |
| 9,173,488 | B1 * | 11/2015 | Bello | A47B 88/70 | |
| 9,999,294 | B2 * | 6/2018 | Leverett, Sr. | A47B 88/75 | |
| 2008/0111455 | A1 * | 5/2008 | Fitz | A47B 88/70 | 312/319.5 |

(Continued)

*Primary Examiner* — James O Hansen

(74) *Attorney, Agent, or Firm* — The Concept Law Group, PA; Scott D. Smiley; Scott M. Garrett

(57) ABSTRACT

A drawer system includes a primary drawer and a concealed drawer. The concealed drawer is concealed in a space under the floor of the primary drawer, between the lower portions of the sidewall of primary drawer. The primary drawer moves with the concealed drawer in a locked state to maintain the concealed drawer in the concealed state, and the concealed drawer moves independently from the primary drawer in the unlocked state to allow the concealed drawer to extend from the primary drawer, thereby allowing access to the concealed drawer.

9 Claims, 9 Drawing Sheets

(56) References Cited

U.S. PATENT DOCUMENTS

| | | | | |
|---|---|---|---|---|
| 2013/0087081 | A1* | 4/2013 | Stukenberg | A47F 7/02 108/23 |
| 2013/0169132 | A1* | 7/2013 | Johnson | A47B 88/70 312/298 |

* cited by examiner

DRAWER SYSTEM HAVING PRIMARY AND CONCEALED DRAWERS

CROSS-REFERENCE TO RELATED APPLICATION

This application claims priority to U.S. Provisional Patent Application No. 62/534,738 titled "Concealed Compartment Assembly and Method of Use," which was filed Jul. 20, 2017, the entirety of which is incorporated by reference.

FIELD OF THE INVENTION

The present invention relates generally to concealed compartments and a method of use, and, more particularly, a concealed compartment assembly used in combination with a container, such as a drawer or other container, that allows for covert storage of sensitive materials and articles independent from the main body of the drawer or container.

BACKGROUND OF THE INVENTION

The storage of sensitive materials, such as firearms and other weapons, poses many problems. Typically, firearms and other sensitive materials are stored in a safe or other type of locked container. However, it is not always desirable or possible to install a safe within a home for a variety of reasons. For example, the home may not provide adequate space for the installation of a safe. In addition, the placement of a safe within a home is an indicator of the likelihood of sensitive materials contained within the safe, which then acts as a target for intruders or children. As such, an intruder or a child may attempt to break into the safe in order to obtain the safe's contents, which poses great danger, especially to the homeowner and the child.

Attempts have been made to provide concealed and inconspicuous containers for the storage of sensitive materials. For example, firearms can be stored in places where an intruder would not typically look for a firearm, such as under a floor panel or in a ceiling. However, such containers remain unsafe, because, while remaining inconspicuous, they may not be capable of locking, they may not be close to the homeowner in the case of a home invasion, and the contents may be discoverable by the intruder. In addition, firearms and other sensitive materials can be stored in concealed compartments of other containers, such as desk drawers. However, typically, these concealed compartments either do not contain locks, or require the use of a sensor and a secondary instrument, such as a magnet or a controller, to unlock them.

Therefore, a need exists to overcome the problems with the prior art as discussed above.

SUMMARY OF THE INVENTION

The invention provides a drawer system having primary and concealed drawers that overcomes the hereinaforementioned disadvantages of the heretofore-known devices and methods of this general type and that provides the concealed drawer in a way that it is concealed by the primary drawer until a concealed latch mechanism is unlocked to allow access to the concealed drawer by allowing the concealed drawer to extend from the primary drawer.

With the foregoing and other objects in view, there is provided, in accordance with the invention, a hidden drawer assembly that includes a primary drawer configured to be moved between a closed position and an opened position relative to a frame, and a concealed drawer which is configured to move with the primary drawer in concealed state where the concealed drawer is coupled to, and concealed under and by the primary drawer, and which can be extended from a front of the primary drawer to reveal a concealed compartment of the concealed drawer in an unlocked state where the concealed drawer is decoupled from the primary drawer.

In accordance with another feature of some embodiments of the inventive disclosure, the concealed drawer is configured to be mounted in the primary drawer, under a floor of the primary drawer, and to an exterior front wall of the hidden drawer assembly.

In accordance with another feature of some embodiments of the inventive disclosure, the primary drawer includes a front wall, and back wall, first sidewall, second side wall, and a floor, where the floor is positioned above a bottom of each of the first and second sidewalls, thereby defining a concealed space between a lower portion of the first sidewall, a lower portion of the second sidewall, and a bottom of the floor. The concealed drawer is configured to be mounted in the concealed space, and to an exterior front wall of the hidden drawer assembly. When the concealed drawer is in the concealed state a front surface of the front wall of the primary drawer is against a back surface of the exterior front wall, and a top of the front wall of the primary drawer is even with a top of the exterior front wall.

In accordance with another feature of some embodiments of the inventive disclosure, the hidden drawer assembly can further include track components mounted on an outside of each of the first and second sidewalls that are configured to mate with corresponding track components in a container in which the hidden drawer assembly can be mounted by the track components to allow the primary drawer to move in and out of the container.

In accordance with another feature of some embodiments of the inventive disclosure, the concealed drawer is configured to be mounted in the concealed space by track components on an outside of each of a first and second sidewall of the concealed drawer which mate with corresponding track components on an inside of the first and second sidewalls of the primary drawer.

In accordance with another feature of some embodiments of the inventive disclosure, the hidden drawer assembly can further include a pull handle at a front surface of the exterior front wall having a shaft that passes through the exterior front wall, wherein rotating the pull handle causes the shaft to rotate in correspondence, the shaft having an engagement feature that selectively engages a latch feature in the front wall of the primary drawer to lock the concealed drawer to the primary drawer in the concealed state when the pull handle is in a first rotation position, and which avoid the latch feature to allow the concealed drawer to move independently of the primary drawer in the unlocked state when the pull handle is in a second rotational position.

In accordance with another feature of some embodiments of the inventive disclosure, the hidden drawer assembly can further include a detent feature configured to resist rotation of the pull handle when in the pull handle is in the first rotation position.

In accordance with another feature of some embodiments of the inventive disclosure, the hidden drawer assembly can further include an electrically controlled latch that locks the concealed drawer to the primary drawer to hold the concealed drawer in the concealed state. The drawer system further includes a radio frequency identification (RFID) reader that is configured to cause the electrically controlled latch to unlock upon reading an authorized RFID device, thereby allowing the concealed drawer to be opened independently of the primary drawer.

In accordance with another feature of some embodiments of the inventive disclosure, the RFID reader is concealed when the concealed drawer is in the concealed state.

In accordance with some embodiments of the inventive disclosure, there is provided a drawer assembly that includes a primary drawer configured to be moved between a closed position and an opened position relative to a container in which the drawer assembly is configured to be mounted. The primary drawer including a front wall, a back wall, first sidewall, second side wall, and a floor. The floor is positioned above a bottom of each of the first and second sidewalls, thereby defining a concealed space between a lower portion of the first sidewall, a lower portion of the second sidewall, and a bottom side of the floor. The drawer assembly can further include a concealed drawer which is configured to move with the primary drawer in concealed state where the concealed drawer is coupled to, and concealed by, the primary drawer, and which can be extended from the primary drawer to reveal a concealed compartment of the concealed drawer in an unlocked state where the concealed drawer is decoupled from the primary drawer. The drawer assembly can further include a concealed latching mechanism that couples the concealed drawer to the primary drawer in the concealed state, and which de-couples the concealed drawer from the primary drawer in the unlocked state.

In accordance with another feature of some embodiments of the inventive disclosure, the concealed drawer is configured to be mounted in the concealed space by respective track components on an outside of each of a first and second sidewall of the concealed drawer which mate with corresponding track components on an inside of the first and second sidewalls of the primary drawer.

In accordance with another feature of some embodiments of the inventive disclosure, the concealed latch mechanism can further include a pull handle at a front surface of the exterior front wall having a shaft that passes through the exterior front wall, wherein rotating the pull handle causes the shaft to rotate in correspondence. The shaft can have an engagement feature that selectively engages a latch feature in the front wall of the primary drawer to lock the concealed drawer to the primary drawer in the concealed state when the pull handle is in a first rotation position, and which avoid the latch feature to allow the concealed drawer to move independently of the primary drawer in the unlocked state when the pull handle is in a second rotational position.

In accordance with another feature of some embodiments of the inventive disclosure, the drawer assembly can further include a detent feature configured to resist rotation of the pull handle when in the pull handle is in the first rotation position.

In accordance with another feature of some embodiments of the inventive disclosure, the concealed latching mechanism can further include an electrically controlled latch that locks the concealed drawer to the primary drawer to hold the concealed drawer in the concealed state, and a radio frequency identification (RFID) reader that is configured to cause the electrically controlled latch to unlock upon reading an authorized RFID device, thereby allowing the concealed drawer to be opened independently of the primary drawer.

the RFID reader is concealed when the concealed drawer is in the concealed state.

In accordance with some embodiments of the inventive disclosure, there is also provided a concealed drawer system that can include a frame having an opening in a front wall, and opposing support members on opposing sides of an inside of the frame. The concealed drawer system can further include a primary drawer that is movably mounted in the frame to the opposing support member thereby allowing the primary drawer to be moved in and out of the frame between a closed position and an open position. The primary drawer can include a front wall, opposing first and second sidewalls, and a floor defining a primary compartment in the primary drawer, wherein the floor is positioned above a bottom of each of the first and second sidewalls, thereby defining a concealed space between a lower portion of the first sidewall, a lower portion of the second sidewall, and a bottom side of the floor. The concealed drawer system can further include a concealed drawer which is mounted in the concealed space in the primary drawer and is configured to move with the primary drawer in concealed state where the concealed drawer is coupled to, and concealed by, the primary drawer, and which can be extended from the primary drawer to reveal a concealed compartment of the concealed drawer in an unlocked state where the concealed drawer is decoupled from the primary drawer, and wherein the concealed drawer is attached to an exterior front wall of the concealed drawer assembly that appears to be part of the primary drawer when the concealed drawer is in the concealed state.

In accordance with another feature of some embodiments of the inventive disclosure, the concealed drawer system can further include a concealed latching mechanism that couples the concealed drawer to the primary drawer in the concealed state, and which de-couples the concealed drawer from the primary drawer in the unlocked state.

In accordance with another feature of some embodiments of the inventive disclosure, the concealed latch mechanism comprises a pull handle at a front surface of the exterior front wall having a shaft that passes through the exterior front wall, wherein rotating the pull handle causes the shaft to rotate in correspondence, the shaft having an engagement feature that selectively engages a latch feature in the front wall of the primary drawer to lock the concealed drawer to the primary drawer in the concealed state when the pull handle is in a first rotation position, and which avoid the latch feature to allow the concealed drawer to move independently of the primary drawer in the unlocked state when the pull handle is in a second rotational position.

In accordance with another feature of some embodiments of the inventive disclosure, the concealed latching mechanism can further include an electrically controlled latch that locks the concealed drawer to the primary drawer to hold the concealed drawer in the concealed state, and a radio frequency identification (RFID) reader that is configured to cause the electrically controlled latch to unlock upon reading an authorized RFID device, thereby allowing the concealed drawer to be opened independently of the primary drawer.

Although the invention is illustrated and described herein as embodied in a drawer system having primary and concealed drawers, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
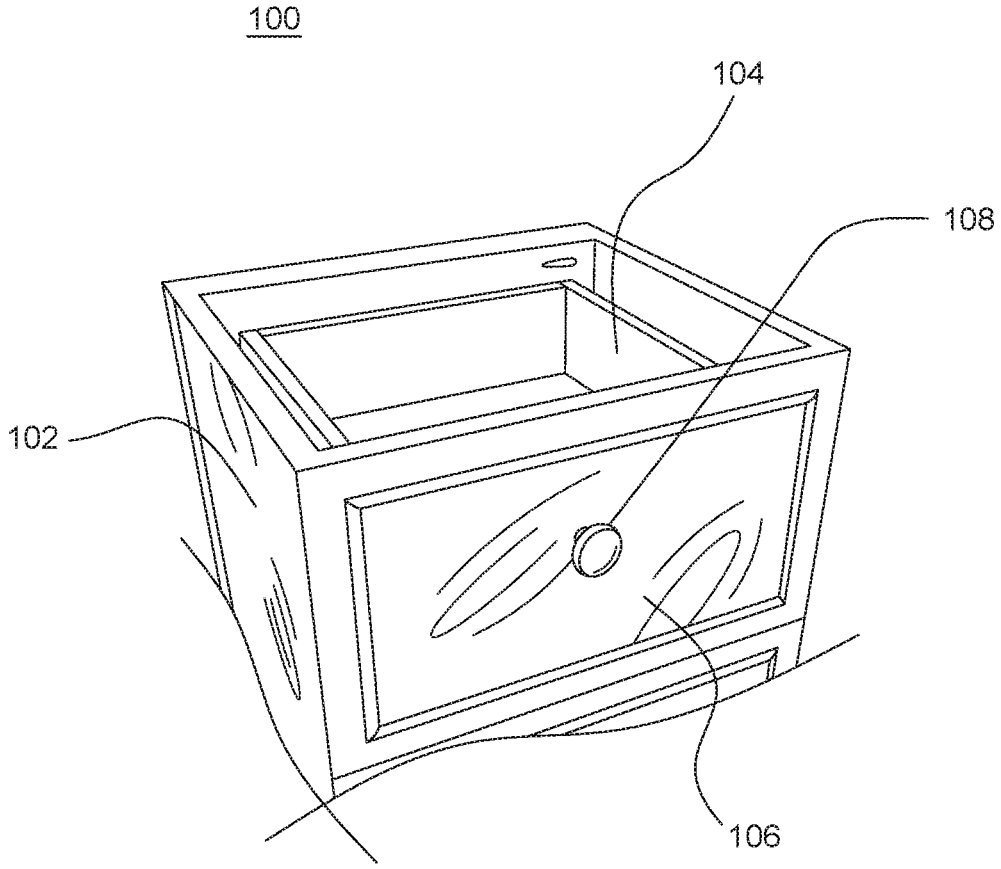
FIG. 1 is a front perspective view of a drawer system having a concealed drawer with the drawers closed, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient drawer assembly having a primary drawer that conceals a concealed drawer which can be selectively exposed by actuation of a hidden latch or locking mechanism. Embodiments of the invention provide a hidden drawer assembly that includes a primary drawer configured to be moved between a closed position and an opened position relative to a frame, and a concealed drawer which is configured to move with the primary drawer in concealed state where the concealed drawer is coupled to, and concealed under and by the primary drawer, and which can be extended from a front of the primary drawer to reveal a concealed compartment of the concealed drawer in an unlocked state where the concealed drawer is decoupled from the primary drawer. In addition, embodiments of the invention provide a concealed drawer system that can include a frame having an opening in a front wall, and opposing support members on opposing sides of an inside of the frame. The concealed drawer system can further include a primary drawer that is movably mounted in the frame to the opposing support member thereby allowing the primary drawer to be moved in and out of the frame between a closed position and an open position. The primary drawer can include a front wall, opposing first and second sidewalls, and a floor defining a primary compartment in the primary drawer, wherein the floor is positioned above a bottom of each of the first and second sidewalls, thereby defining a concealed space between a lower portion of the first sidewall, a lower portion of the second sidewall, and a bottom side of the floor. The concealed drawer system can further include a concealed drawer which is mounted in the concealed space in the primary drawer and is configured to move with the primary drawer in concealed state where the concealed drawer is coupled to, and concealed by, the primary drawer, and which can be extended from the primary drawer to reveal a concealed compartment of the concealed drawer in an unlocked state where the concealed drawer is decoupled from the primary drawer, and wherein the concealed drawer is attached to an exterior front wall of the concealed drawer assembly that appears to be part of the primary drawer when the concealed drawer is in the concealed state.

FIG. 1 is a front perspective view of a drawer system 100 having a hidden drawer assembly that includes a concealed drawer with the drawers closed, in accordance with some embodiments. The system 100 comprises drawers in a cabinet, container, or frame 102, in which a primary drawer 104 is mounted. The primary drawer 104 is typically mounted in the frame 100 on opposing support members on opposing sides of an inside of the frame, and conceals a concealed drawer, which as a result is not seen in FIG. 1, when the drawers are in the closed position. An exterior front wall 106 acts as a visible front wall for both the primary drawer 104 and the concealed drawer. The concealed drawer is under the primary drawer 104, and extends from the primary drawer 104 when unlocked from the primary drawer 104. To maintain the concealed drawer in the concealed state, the concealed drawer can be locked to the primary drawer such the concealed drawer, primary drawer 104, and exterior front wall 106 all move together as a unit such that the exterior front wall 106 appear integral with, and indistinguishable from, the primary drawer 104 to casual viewing. The drawers are mounted in the frame 102 on, for example, sliding tracks, and can be moved by pulling on pull handle 108. In some embodiments, pull handle 108 can operate as a latch by being rotated into latched/unlatched states to lock or unlock the concealed drawer to/from the primary drawer 104.

Figure 2:
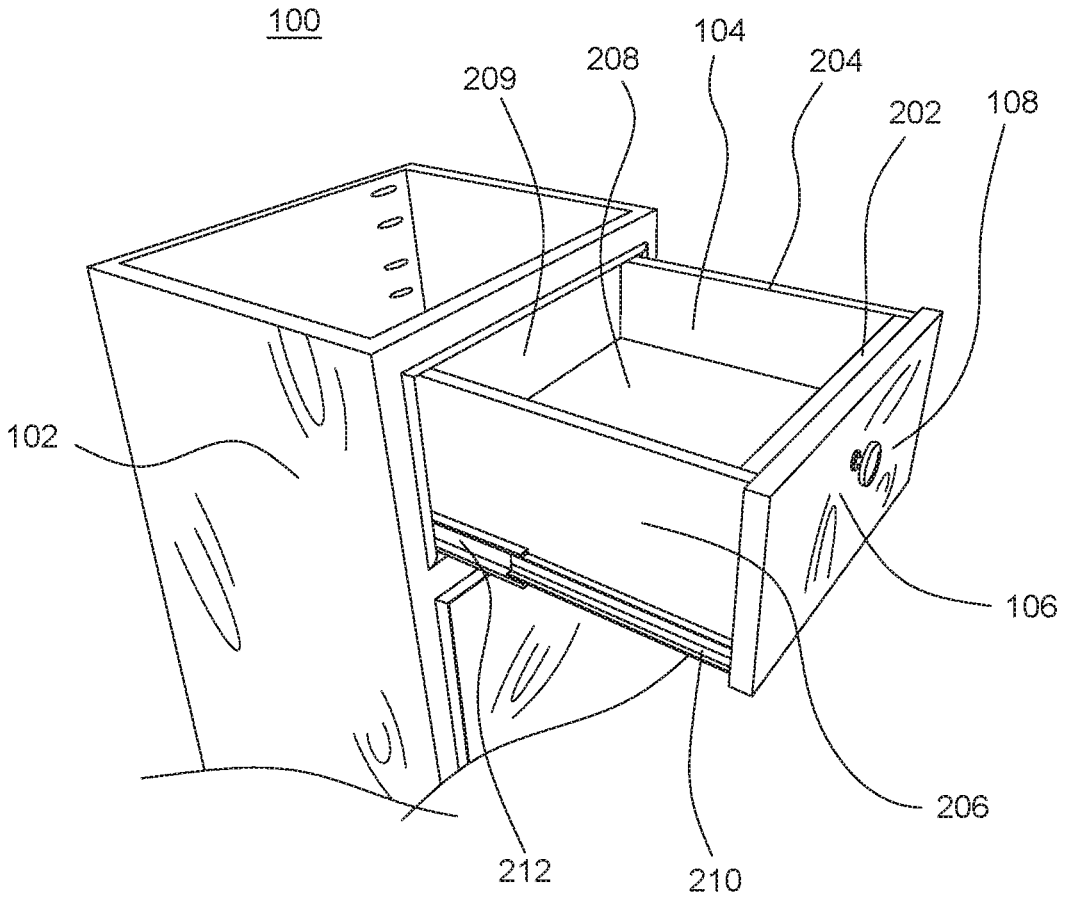
FIG. 2 is a perspective view of a drawer system having a concealed drawer in a concealed state with a primary drawer open, in accordance with some embodiments.

FIG. 2 is a perspective view of the drawer system 100 having a concealed drawer in a concealed state with a primary drawer 104 in an open position, in accordance with some embodiments. In this view the primary drawer 104 is pulled out of the frame 102. The primary drawer 104 has a front wall 202 that is against the back of the exterior front wall 106, and the top of the front wall 202 is flush with the top of the exterior front wall 106 to appear to be formed or joined together. The primary drawer 104 further has side walls 204, 206, a floor 208 and a rear wall 209 defining a primary compartment. The floor is at a level, relative to the exterior front wall 106, that is above the bottom of the exterior front wall 106. The space under the floor 208 down to the bottom of the exterior front wall 106 is where the concealed drawer is concealed. The primary drawer 104 included track components to slide in and out of the frame 102 such as track component 210 that are configured to mate with track component 212, which can include rollers, as is well known.

Figure 3:
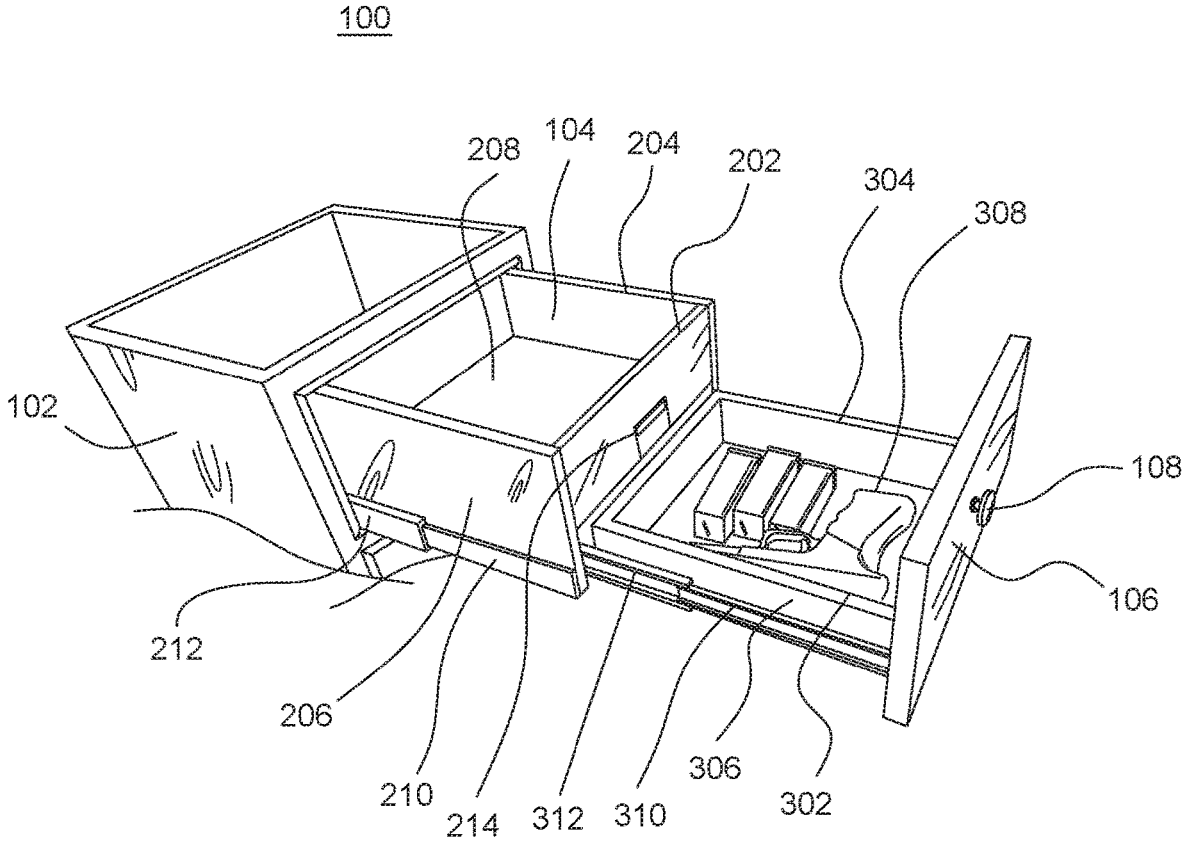
FIG. 3 is a perspective view of a drawer system having a concealed drawer open in an unlocked state, extending from the primary drawer, in accordance with some embodiments.

FIG. 3 is a perspective view of the drawer system 100 having a concealed drawer 302 open in an unlocked state, extending from the primary drawer 104, in accordance with some embodiments. In this view it can be seen that the concealed drawer 302 is concealed under the floor 208 of the primary drawer 104, and between the lower portions of the side walls 204, 206. Here, the exterior front wall 106 is now separated from the front wall 202 of the primary drawer 104 to reveal the concealed drawer 302. The concealed drawer 302 further includes sidewalls 304, 306, and a floor 308. The front of the concealed drawer 302 is formed by the exterior front wall 106. As the primary drawer 104 is mounted on sliding track components 210, 212 to slide in and out of frame 102, likewise the concealed drawer 302 is mounted on track components 310, 312 that mate with the inside of the lower portions of the sidewalls 204, 206 of the primary drawer 104.

In the embodiment of FIG. 3, the concealed drawer 302 can be locked in the concealed state by means of a latch plate 214 in the front of the front wall 202 of the primary drawer 104. The latch plate can be flush with the front of the front wall 202, with a recess behind it, which allows a latch member (not seen here) coupled to the pull handle 108 to engage or disengage the latch plate 214. The pull handle 108 can be turned or rotated to move the latch member into or out of engagement with the latch plate, thereby controlling whether the concealed drawer 302 is locked in the concealed state or able to be extended from the primary drawer 104 to reveal the concealed drawer 302.

Figure 4:
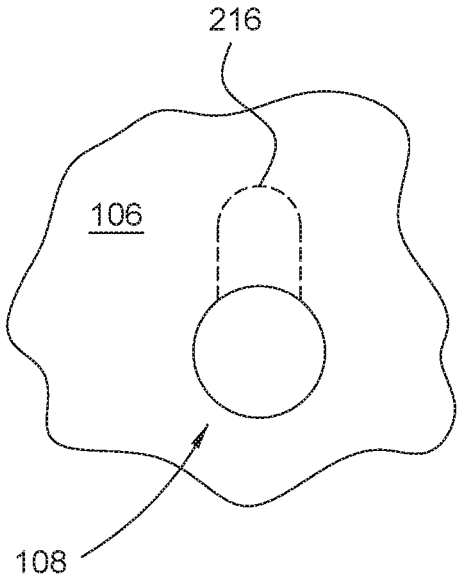
FIG. 4 is a front view of a latching pull handle on the front of a drawer system that lock and unlocks the primary drawer from the concealed drawer, in a locked position, in accordance with some embodiments.

FIG. 4 is a front view of a latching pull handle 108 on the front of a concealed drawer system that lock and unlocks the primary drawer 104 from the concealed drawer 302, in a locked position, in accordance with some embodiments. The pull handle 108 is part of a concealed latch mechanism that includes a shaft 602 of the pull handle 108 that passes through the exterior front wall 106, and is connected to an engagement feature such as latch member 216 that is behind the exterior front wall 106, and thus shown in broken line. In FIG. 4 the latch member 216 is in an upright position, and can be behind an latch feature such as latch plate 214, which is mounted on the front of the front wall 202 of the primary drawer 104.

Figure 5:
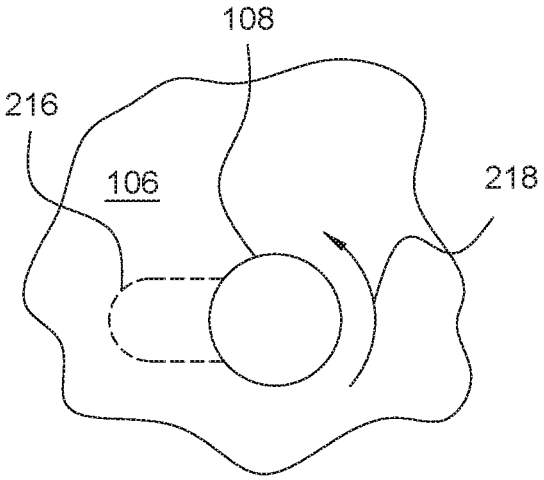
FIG. 5 is a front view of a latching pull handle on the front of a drawer system that locks and unlocks the primary drawer from the concealed drawer, in an unlocked position, in accordance with some embodiments.

FIG. 5 is a front view of a latching pull handle 108 on the front of a drawer system that locks and unlocks the primary drawer 104 from the concealed drawer 302, in an unlocked position, in accordance with some embodiments. The pull handle 108 is turned, as indicated by arrow 218, causing the latch member 216 to move as shown, which de-couples the concealed drawer by disengaging the latch member 216 from the latch plate 214, and thereby allowing the concealed drawer 302 to move separately from the primary drawer 104 to reveal the concealed drawer 302 and allow access to the concealed drawer 302.

Figure 6:
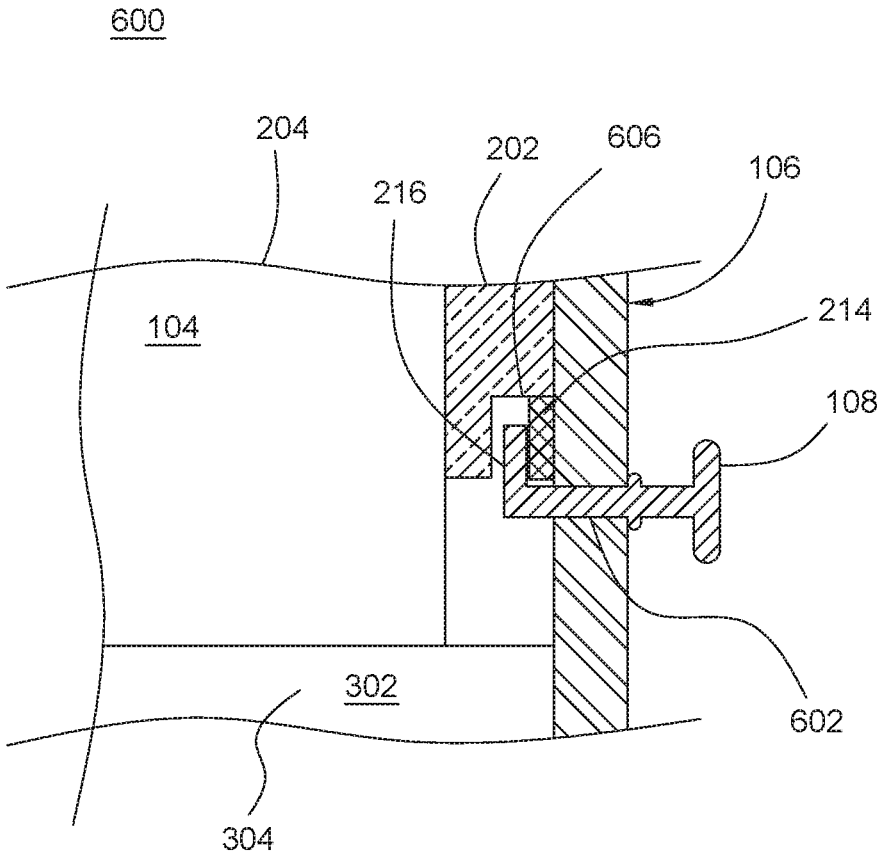
FIG. 6 is a side cutaway view of a locking latch system for a drawer system having a concealed drawer, in accordance with some embodiments.

FIG. 6 is a side cutaway view of a locking latch system 600 for a drawer system having a concealed drawer, in accordance with some embodiments. The pull handle 108 (or pull knob) includes a shaft 602 that passes through the exterior front wall 106. The front wall 202 of the primary drawer 104 includes a recess 606 over which a latch plate 214 is mounted. The latch member 216 can be turned by rotating the pull handle 108 (which rotates the shaft 602) into or out of engagement with the back of the latch plate. When engaged, the front wall 202 of the primary drawer is brought into intimate contact with the back of the exterior front wall 106, and the concealed drawer 302 and primary drawer 104 move together as a unit with the concealed drawer 302 in the concealed state. That is, in the concealed state, the front surface of the front wall 202 is in contact with the back surface of the exterior front wall 106. When the pull handle 108 is pulled (i.e. to the right of the page), the force exerted on the pull handle 108 is transferred through the shaft 602 and latch member 216 to the back of the latch plate 214 and thereby to the primary drawer 104. When the drawers are closed, pushing on the pull handle 108 exerts a force into the exterior front wall 106, and thereby into the front wall 202 of the primary drawer 104, thereby moving the primary drawer 104 back into the frame (i.e. towards the left of the page).

Figure 8:
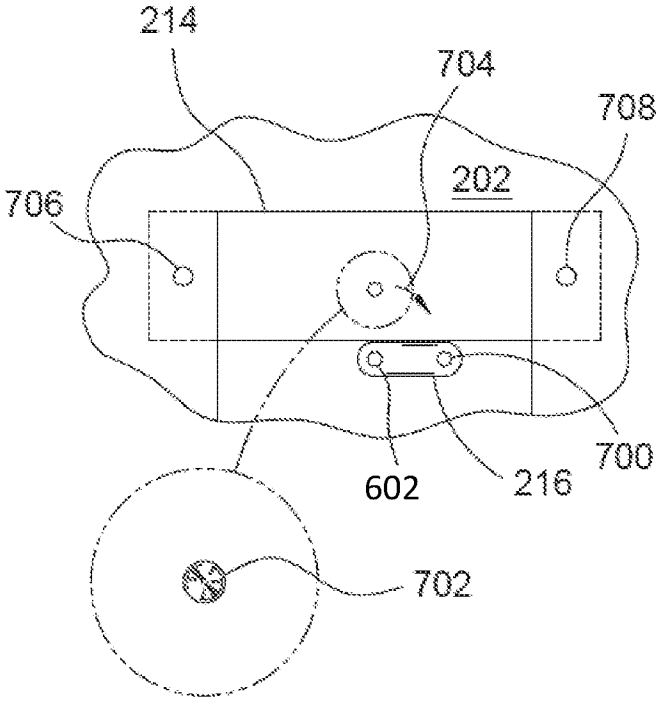
FIG. 8 is a rear view of a latching system in an unlatched or unlocked position, unlocking a concealed drawer from the primary drawer to reveal the concealed drawer, in accordance with some embodiments.
Figure 7:
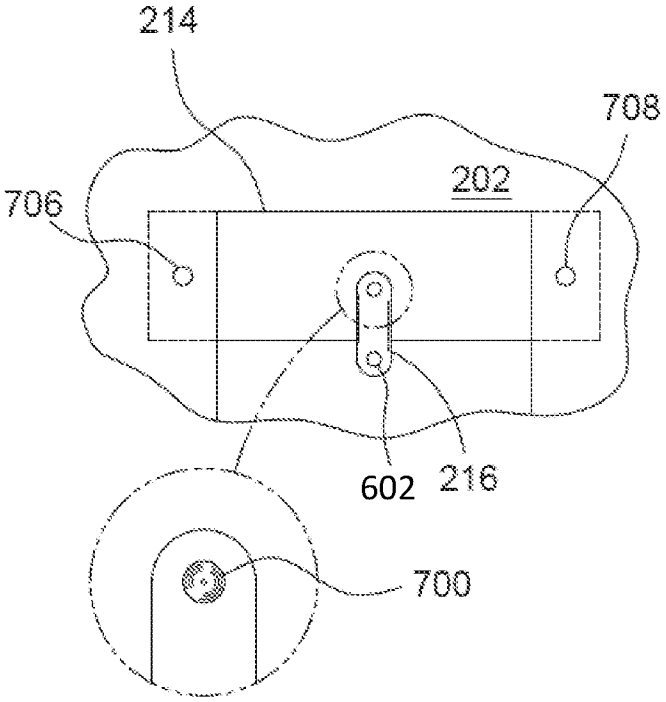
FIG. 7 is a rear view of a latching system in a latched or locked position, locking a concealed drawer to a primary drawer to conceal the concealed drawer, in accordance with some embodiments.

FIG. 7 is a rear view of a latching system in a latched or locked position, locking a concealed drawer to a primary drawer to conceal the concealed drawer, in accordance with some embodiments. In FIGS. 7 and 8, the view is looking in the opposite direction from the views of FIGS. 4-5, from inside the primary drawer 104. Specifically, from inside the recess 606 in the front wall 202 of the primary drawer 104, over which the latch plate 214 is mounted. The latch plate 214 can be mounted in the front wall 202 of the primary drawer 104 by screws 706, 708 into the front of the front wall 202. As can be seen, the latch member 216 is in engagement with the back of the latch plate 214. To prevent undesirable turning of the pull handle, a detent feature can be formed by a dimple 700 that produces a corresponding bump on the front of the latch member 216 which frictionally engages a corresponding depression 702 in the back of the latch plate 214, as seen in FIG. 8.

FIG. 8 is a rear view of a latching system in an unlatched or unlocked position, unlocking a concealed drawer from the primary drawer to allow the concealed drawer to be revealed, in accordance with some embodiments. The view of FIG. 8 is the same as in FIG. 7, with the difference of the pull handle having been rotated to cause the latch member 216 to turn, as indicated by arrow 704, thereby removing the latch member 216 from engagement with the latch plate 214, and allowing the concealed drawer to be moved independent of the primary drawer so that the concealed drawer can be revealed and accessed. The detent feature of dimple 700 and depression 702 can cause resistance to the pull handle being rotated so that it does not rotate freely, preventing a person who is not aware of the concealed drawer from inadvertently discovering the concealed drawer. Since the latch plate and latch member are disposed in the front wall 202 of the primary drawer, when the concealed drawer is locked in the concealed state, there is no visible indication of the latching mechanism in view, which further conceals the presence of the concealed drawer from anyone who may open the drawer system that is not aware of the concealed drawer.

Figure 9:
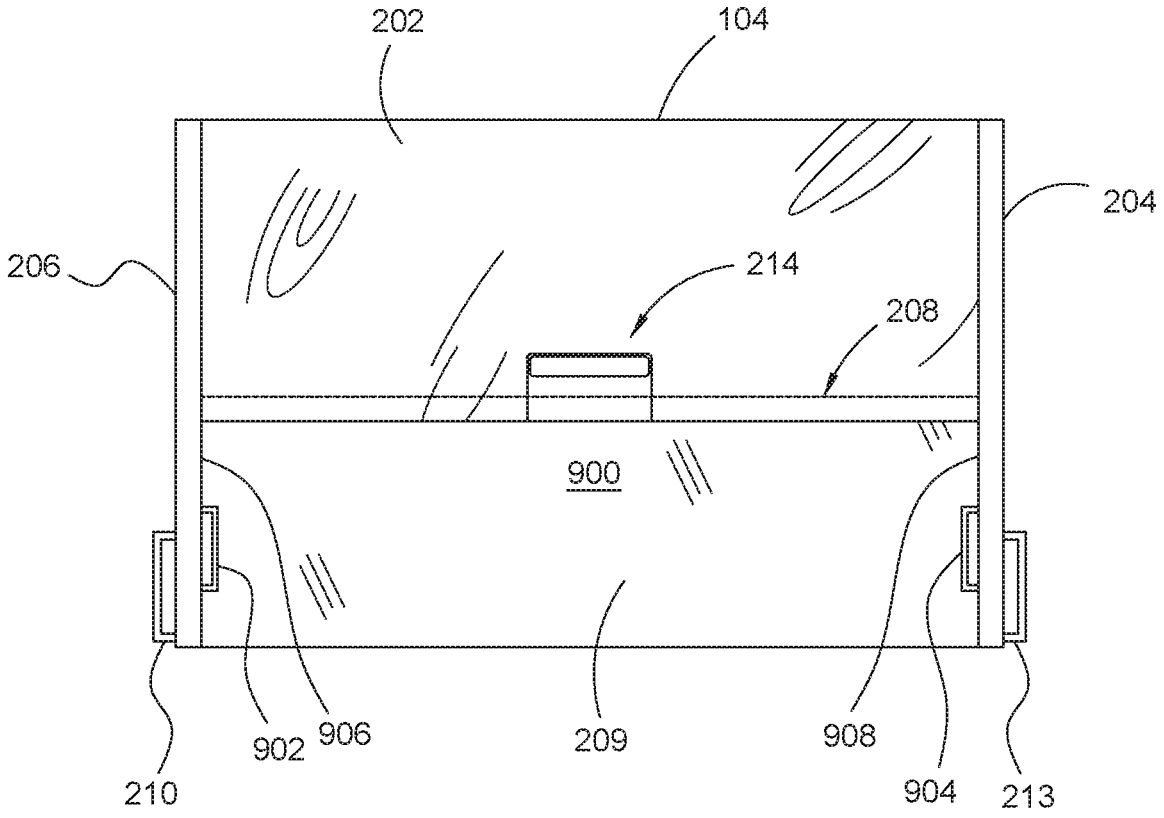
FIG. 9 is a front elevational view of a primary drawer having a latch for locking a concealed drawer to the primary drawer, in accordance with some embodiments.

FIG. 9 is a front elevational view of a primary drawer 104 having a latch for locking a concealed drawer to the primary drawer 104, in accordance with some embodiments. In this view the concealed drawer is removed from the primary drawer 104. As in FIG. 2, the primary drawer 104 includes a front wall 202, side walls 204, 206, a floor 208 (hidden here behind front wall 202), and a back wall 209. The bottom side 910 of the floor 208, and the lower portions 906, 908 of the sidewalls 206, 204, respectively, and the back wall 209, define a space 900 in which the concealed drawer can be mounted, similarly, if not exactly the same way as the primary drawer 104 is mounted in the frame 102. The primary drawer 104 includes track components 210, 213 on the outside of the lower portions 906, 908. Track components 902, 904 are mounted in the inside of the lower portions 906, 908 of the side walls 206, 204 to mount the concealed drawer and allow the concealed drawer to slide/move in and out of the concealed space 900 when not locked in the concealed state or position. The latch plate 214 is mounted over the recess 606 to allow the exterior front wall, which is connected to the concealed drawer, to be coupled against the front of the front wall 202 of the primary drawer 104.

Figure 10:
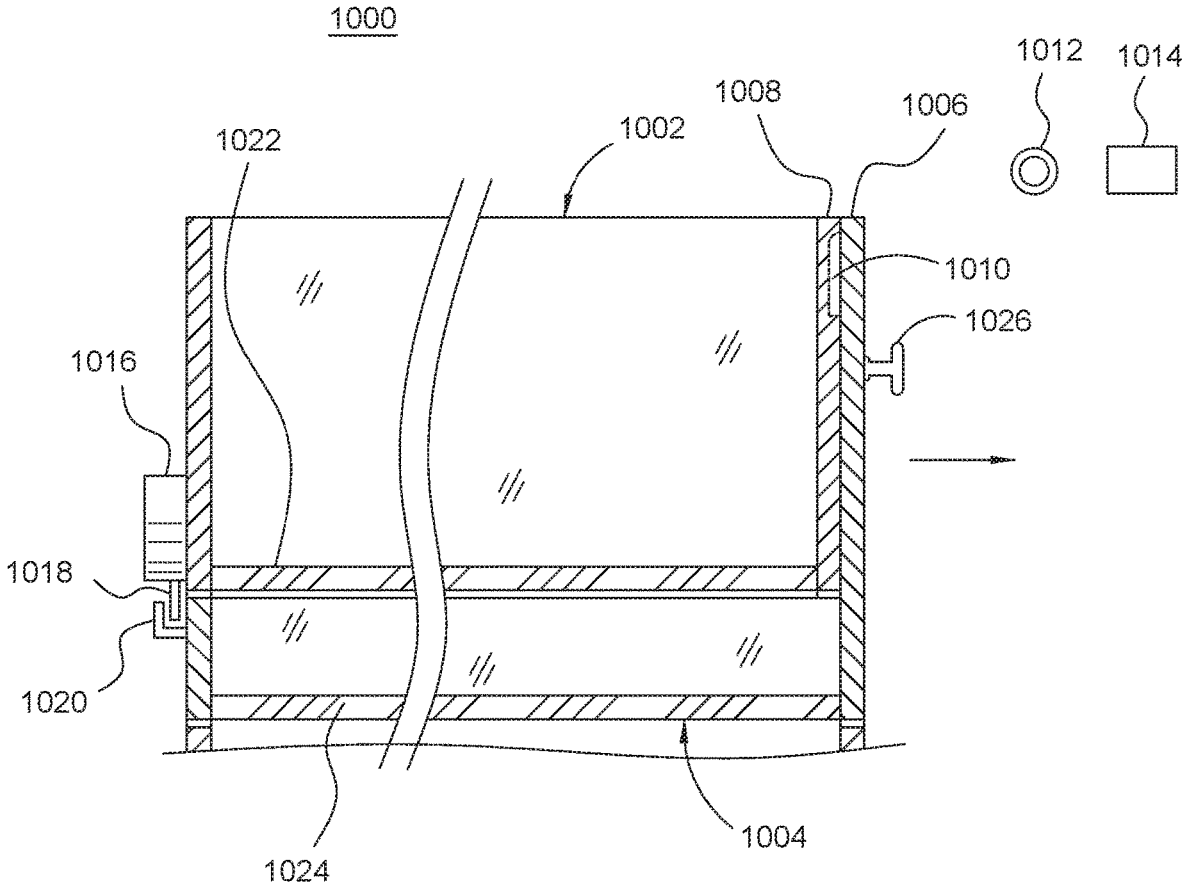
FIG. 10 is a side cutaway view of a drawer system having a concealed drawer in a locked state that is unlocked from the primary drawer by use of an RFID device, in accordance with some embodiments.

FIG. 10 is a side cutaway view 1000 of a drawer system having a concealed drawer 1004 in a locked state that is unlocked from the primary drawer 1002 by use of an electrically controlled latch, such as a radio frequency identification device (RFID) controlled latch, in accordance with some embodiments. The drawer system 1000 includes an exterior front wall 1006 that, in the locked or concealed state, is against the front wall 1008 of the primary drawer 1002, thereby concealing the concealed drawer 1004 under the floor 1022 of the primary drawer 1002, and between the lower portions of the sidewalls of the primary drawer 1002. An RFID reader 1010 can also be concealed in the front wall 1008 of the primary drawer 1002, in a recess in the front face of the front wall 1008 so that the exterior front wall 1006 hide the RFID reader 1010 from view when the concealed drawer 1004 is in the concealed state. The RFID reader can periodically emit a radio frequency signal that causes an RFID device to respond with its identification information. RFID devices can be formed in a variety of configurations, including as a ring 1012, or a card 1014. The RFID device 1012, 1014 includes an energy scavenging antenna to collect energy from the RFID reader 1010, and uses that energy to transmit a unique identifier back to the RFID antenna. The RFID reader 1010 is connected to a latch controller 1016 on the outside of the back wall of the primary drawer 1002 that controls a latch member 1018 by an electric motor to rotate the latch member 1018 into, or out of engagement with a corresponding latch catch 1020 on the outside of the back wall of the concealed drawer 1004. In the concealed and locked state the latch member 1018 is engaged in an interference relationship with the latch catch 1020. When the RFID device 1012, 1014 responds with an authorized identifier, then the latch controller 1016 will move the latch member 1018 out of engagement with the latch catch 1020 momentarily to allow the concealed drawer 1004 to be accessed, where items can be placed on the floor 1024 of the concealed drawer 1004. Accordingly, with the latch member 1018 engaged with the latch catch 1020, when a user pulls on the pull handle 1026, the latch catch 1020 exerts force on the latch member 1018 to cause the primary drawer to move with the motion of the pull handle 1026. When the user pushes in the pull handle 1026 to close the drawer, the force is translated from the exterior wall 1006 to the front wall 1008 of the primary drawer 1002.

Figure 11:
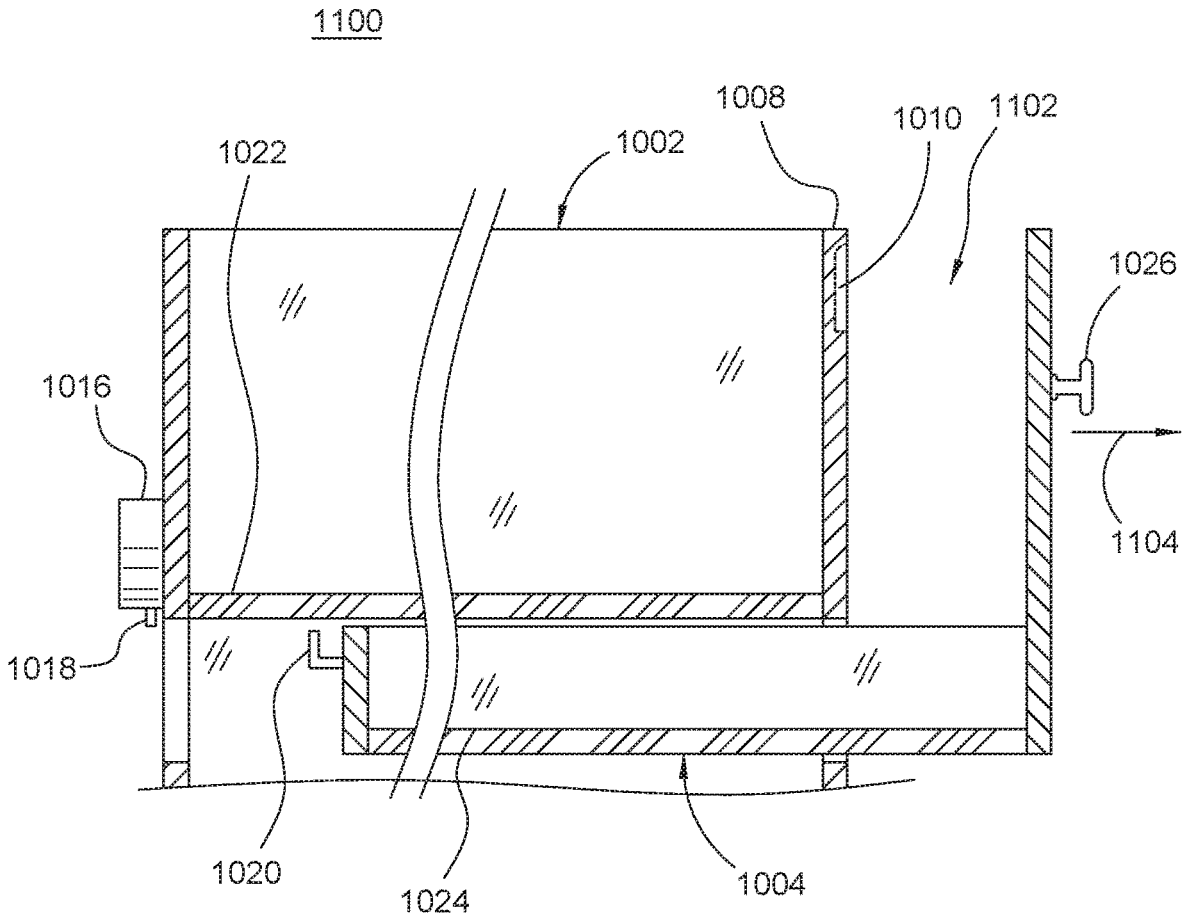
FIG. 11 is a side cutaway view of a drawer system having a concealed drawer in an unlocked state that is unlocked from the primary drawer by use of an RFID device, in accordance with some embodiments.

FIG. 11 is a side cutaway view 1100 of a drawer system having a concealed drawer 1004 in an unlocked state that is unlocked from the primary drawer 1002 by use of an RFID device 1012, 1014, in accordance with some embodiments.

In this view 1100, the same components of the drawer system of FIG. 10 are shown, but with the concealed drawer 1004 being unlocked and opened to allow access to the concealed drawer 1004 through an opening 1102 created by moving the concealed drawer independently from the primary drawer 1002 as a result of having used the RFID device 1012, 1014 to unlock the concealed drawer 1004 from the primary drawer 1002. In other words, when an authorized identifier is received at the RFID reader 1010, the latch controller 1016 rotates the latch member 1018 so that it is no longer interfering with the latch catch 1020, thereby allowing the concealed drawer 1004 to move without causing the primary drawer 1002 to move with it. The latch controller 1016 can maintain the latch member 1018 in the unlocked position until the RFID device (e.g. 1012, 1014) is no longer present, as determined by the RFID reader 1010 no longer receiving transmissions from the RFID device. In some embodiments, the latch catch 1020 can be a ramped member that deflects as is passes by the latch member 1018 to capture the latch member 1018 in the locked state in cases where the latch member 1018 is rotated out of interference momentarily and rotates back before the user closes the concealed drawer 1004. In some embodiments both the RFID control and the locking pull handle latch assembly of FIGS. 4-9 can be used to prevent inadvertent unlocking of the concealed drawer 1004 by the presence of the RFID device 1012, 1014.

A drawer system has been disclosed that includes a primary drawer and a concealed drawer. The concealed drawer is concealed in a space under the floor of the primary drawer, between the lower portions of the sidewall of primary drawer. The primary drawer moves with the concealed drawer in a locked state to maintain the concealed drawer in the concealed state, and the concealed drawer moves independently from the primary drawer in the unlocked state to allow the concealed drawer to extend from the primary drawer, thereby allowing access to the concealed drawer.

What is claimed is:

1. A hidden drawer assembly, comprising:

a primary drawer configured to be moved between a closed position and an opened position relative to a frame, the primary drawing having a pair of sidewalls and a floor and a front wall, the front wall being at a front of the primary drawer above the floor and between sidewalls of the primary drawer, wherein the sidewalls have lower portions that extend below the floor, each sidewall of the primary drawer having a track on the outside of the sidewall configured to mount the primary drawer in the frame;

a concealed drawer, having a pair of sidewalls, which is configured to move with the primary drawer in concealed state when locked to the primary drawer, where sidewalls of the concealed drawer are coupled to a respective one of the lower portion of the sidewalls of the primary drawer by a track mounted between an inside of the lower portion of the sidewall of the primary drawer and an outside of the sidewall of the concealed drawer, and concealed under the floor of the primary drawer and between the lower portions of the sidewalls of the primary drawer, and wherein the concealed drawer can be extended from under the primary drawer to reveal a concealed compartment of the concealed drawer when the concealed drawer is unlocked from the primary drawer;

an exterior front wall that forms a front of the hidden drawer assembly, and which forms a front wall of the concealed drawer has a top that is flush with a top of the front wall of the primary drawer; and a latch disposed on an outside of a rear wall of the primary drawer that engages a corresponding latch member on an outside of a rear wall of the concealed drawer, wherein the latch is engaged with the latch member in the locked state and disengaged with the latch member in the unlocked state.

2. The hidden drawer assembly of claim 1, wherein the latch is an electrically controlled latch; and the hidden drawer assembly further comprises a radio frequency identification (RFID) reader that is concealed in the front wall of the primary drawer and that is configured to cause the electrically controlled latch to unlock upon reading an authorized RFID device, thereby allowing the concealed drawer to be opened independently of the primary drawer.

3. The hidden drawer assembly of claim 2, wherein the RFID reader is concealed when the concealed drawer is in the concealed state.

4. A drawer assembly, comprising:

a primary drawer configured to be moved between a closed position and an opened position relative to a container in which the drawer assembly is configured to be mounted, the primary drawer including a front wall, a back wall, first sidewall, second sidewall, and a floor, wherein the floor is positioned above a bottom of each of the first and second sidewalls, thereby defining a concealed space between a lower portion of the first sidewall, a lower portion of the second sidewall, and a bottom side of the floor, the primary drawer further having a track component on an outside of the first sidewall and a track component on an outside of the second sidewall to moveably mount the primary drawer in a frame;

a concealed drawer disposed under the floor of the primary drawer between the lower portion of the first sidewall of the primary drawer and the lower portion of the second sidewall of the primary drawer, the concealed drawer having a first sidewall and a second sidewall, a first track component mounted between an inside of the lower portion of the first sidewall of the primary drawer and the first sidewall of the concealed drawer, and a second track component mounted between an inside of the lower portion of the second sidewall of the primary drawer and the second sidewall of the concealed drawer, wherein the concealed drawer is configured to move with the primary drawer in a concealed state where the concealed drawer is locked to the primary drawer, and wherein the concealed drawer can be extended from the primary drawer to reveal a concealed compartment of the concealed drawer when the concealed drawer is unlocked from the primary drawer;

an exterior front wall that forms a front of the hidden drawer assembly, and which forms a front wall of the concealed drawer has a top that is flush with a top of the front wall of the primary drawer; and a concealed latching mechanism that locks the concealed drawer to the primary drawer in the concealed state, and which unlocks the concealed drawer from the primary drawer in an unlocked state, wherein the concealed latching mechanism includes a latch disposed on an outside of a rear wall of the primary drawer that engages a corresponding latch member on an outside of a rear wall of the concealed drawer, wherein the latch is engaged with the latch member in the locked state and disengaged with the latch member in the unlocked state.

5. The drawer assembly of claim 4, wherein the latch is an electrically controlled latch; and the concealed latching mechanism further includes a radio frequency identification (RFID) reader disposed in a front side of the front wall of the primary drawer and that is configured to cause the electrically controlled latch to unlock upon reading an authorized RFID device, thereby allowing the concealed drawer to be opened independently of the primary drawer.

6. The drawer assembly of claim 5, wherein the RFID reader is concealed when the concealed drawer is in the concealed state.

7. A concealed drawer system, comprising:

a frame having an opening in a front wall, and opposing support members on opposing sides of an inside of the frame;

a primary drawer that is movably mounted in the frame to the opposing support members thereby allowing the primary drawer to be moved in and out of the frame between a closed position and an open position, the primary drawer including a front wall, opposing first and second sidewalls, and a floor defining a primary compartment in the primary drawer, and wherein the floor is positioned above a bottom of each of the first and second sidewalls, thereby defining a concealed space between a lower portion of the first sidewall, a lower portion of the second sidewall, and a bottom side of the floor, wherein the sidewalls of the primary drawer are moveably mounted in the frame on the opposing support members;

a concealed drawer having a first sidewall and a second sidewall and which is mounted in the concealed space in the primary drawer and is configured to move with the primary drawer in a concealed state where the concealed drawer is locked to, and concealed by, the primary drawer, and which can be extended from the primary drawer to reveal a concealed compartment of the concealed drawer in an unlocked state where the concealed drawer is unlocked from the primary drawer, wherein the concealed drawer is mounted between lower portions of the first and second sidewalls of the primary drawer on a first track component between an inside of the lower portion of the first sidewall of the primary drawer and the first sidewall of the concealed drawer and a second track component between an inside of the lower portion of the second sidewall of the primary drawer and the second sidewall of the concealed drawer, and wherein the concealed drawer is attached to an exterior front wall of the concealed drawer assembly that appears to be part of the primary drawer when the concealed drawer is in the concealed state; and a latch disposed on an outside of a rear wall of the primary drawer that engages a corresponding latch member on an outside of a rear wall of the concealed drawer, wherein the latch is engaged with the latch member in the locked state and disengaged with the latch member in the unlocked state.

8. The concealed drawer system of claim 7, wherein the latch is an electrically controlled latch; and the concealed drawer system further includes a radio frequency identification (RFID) reader that is configured to cause the electrically controlled latch to unlock upon reading an authorized RFID device, thereby allowing the concealed drawer to be opened independently of the primary drawer.

9. The concealed drawer system of claim 8, wherein the RFID reader is disposed in a front side of the front wall of the primary drawer such that the RFID reader is concealed when the primary drawer is locked to the concealed drawer.

* * * * *